US005975974A

United States Patent [19]

McCausland

[11] Patent Number: 5,975,974

[45] Date of Patent: Nov. 2, 1999

[54] REMOVABLE SURF FIN SYSTEM

[75] Inventor: William Thomas McCausland, New South Wales, Australia

[73] Assignee: Sunbum Pty. Limited, Mona Vale, Australia

[21] Appl. No.: 08/941,398

[22] Filed: Sep. 30, 1997

[30] Foreign Application Priority Data

Oct. 1, 1996 [AU] Australia ..... PO 2695

[51] Int. Cl.[6] ..... B63B 1/00

[52] U.S. Cl. ..... 441/79

[58] Field of Search ..... 441/65, 74, 79; 14/39.2, 127, 132, 138, 39.21

[56] References Cited

U.S. PATENT DOCUMENTS

| | | | |
|---|---|---|---|
| 5,464,359 | 11/1995 | Whitty | 441/79 |
| 5,503,581 | 4/1996 | McCulloguh | 441/79 |

FOREIGN PATENT DOCUMENTS

| | | |
|---|---|---|
| 657456 | 3/1995 | Australia . |
| A 81502/94 | 6/1995 | Australia . |
| 0 033 072 | 8/1981 | European Pat. Off. . |
| 0 473 207 | 3/1992 | European Pat. Off. . |
| 2 699 969 | 7/1994 | France . |
| 29 49 436 A1 | 6/1981 | Germany . |
| 33 39 686 A1 | 5/1985 | Germany . |
| 1149184 | 4/1969 | United Kingdom . |

*Primary Examiner*—Stephen Avila
*Attorney, Agent, or Firm*—Smith, Gambrell & Russell, LLP

[57] ABSTRACT

A surf fin fixing system for a surfcraft (18) comprises one or more embedded fixing elements (20) with fixing cavities (22) which receive fixing formations (16) of the fin (10). The fixing element includes a cam (24') with a generally horizontal axis parallel to the fin and actuating means (42) causing the cam to apply force to the fixing formation and thus lock the fin onto the surfcraft.

10 Claims, 4 Drawing Sheets

REMOVABLE SURF FIN SYSTEM

BACKGROUND OF THE INVENTION

The invention relates to a removable fin system for surfcraft such as surfboards.

DESCRIPTION OF THE PRIOR ART

In the manufacture of surfboards, a body of plastics foam material is shaped and then covered with a layer of fibre-reinforced resin, normally fiberglass.

One or more fins, most commonly three, are fixed to the board at the rear, normally by one of two methods, either by attaching the fins to the board by means of fibre reinforced resin around the base of the fin, or by the use of a so-called "fin box".

Each of these approaches has significant disadvantages, as discussed in Australian Patent No. 657456, which discloses a removable fin system for surfboards and the like in which tabs extending from the end surface of each removable fin are received in cavities of fixing plugs embedded in the board. Obliquely extending grub screw are then tightened to extend into the cavity and bear against the side of each tab, locking the fin onto the board.

This system has been successfully employed and marketed but, while simple in design, requires a multitude of operations to install to keep the screw head free of sanding dust, and cutting and polishing compounds from finishing of the board, which may set in the screw head and lead to stripping of the screw head or key due to ill-fitting. Also, when used in conjunction with fiberglass fins the screw tip may chew into the fin tab, causing a divot point or burring of the tab. The present inventors consider that the existing system can be improved upon in terms of speed and simplicity of operation and installation.

Australian Patent Application No. 81502/94 proposed a fin fixing system in which tabs on the fin were held in corresponding cavities of embedded fixing elements by means of a tongue forced across by insertion of a plug member. This system was marketed briefly but discontinued due to lack of reliability.

SUMMARY OF THE INVENTION

The present invention seeks to provide a reliable and simple fin fixing system.

In one form, there is provided a surf fin fixing assembly for a surfcraft, having one or more fixing elements adapted to be embedded in the surfcraft, the elements having a fixing cavity therein adapted to receive a fixing formation, a surf fin having a pair of generally vertical lateral surfaces, an end surface and one or more fixing formations adapted to be received in the fixing cavities, a cam having generally horizontal axis parallel to the fin and means for actuating the cam to apply a force to a said fixing formation.

Preferably, the fixing element is elongate in the longitudinal direction of the cam, with one fixing element employed for each fin. The elongate fixing element may conveniently be shaped as two or more overlapping cylinders, to facilitate installation using a hole saw. For fins with a long base length, such as fins for longboards, two or more closely spaced or abutting fixing elements may be installed per fin.

BRIEF DESCRIPTION OF THE DRAWINGS

Further preferred embodiments will now be described with reference to the accompanying drawings, in which.

DETAILED DESCRIPTION OF THE PREFERRED EMBODIMENTS

Figure 1:
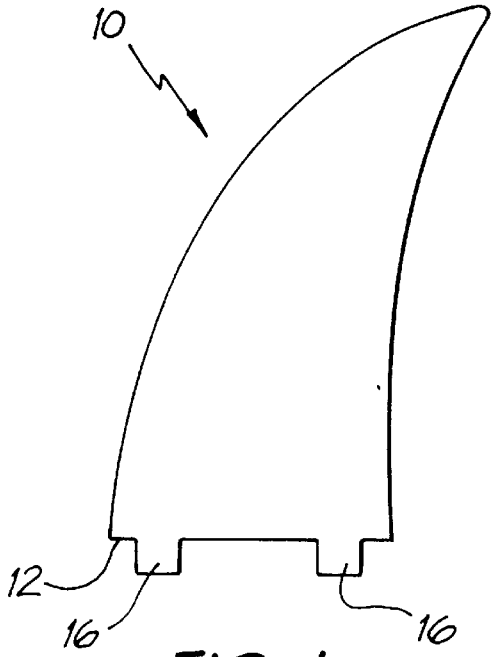
FIGS. 1 and 2 are side and end elevations respectively of a surfboard fin adapted for use with the fin fixing system.
Figure 2:
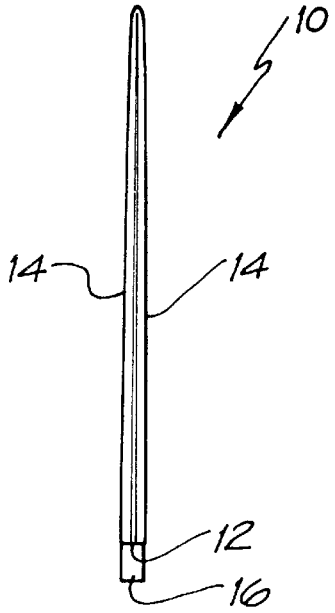
Figure 3:
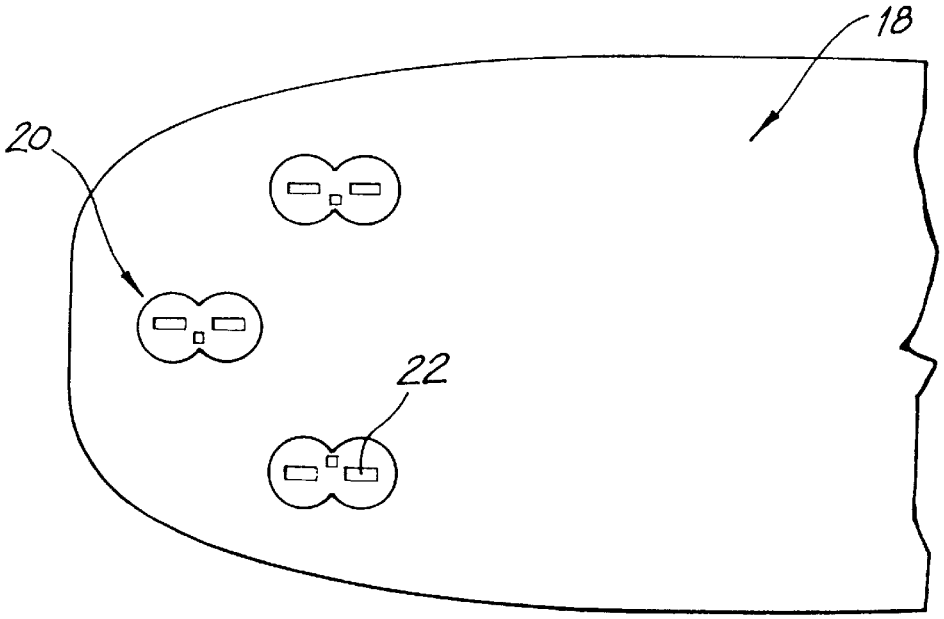
FIG. 3 is a view of the bottom rear part of a surfboard fitted with fixing plugs according to the first embodiment.
Figure 4:
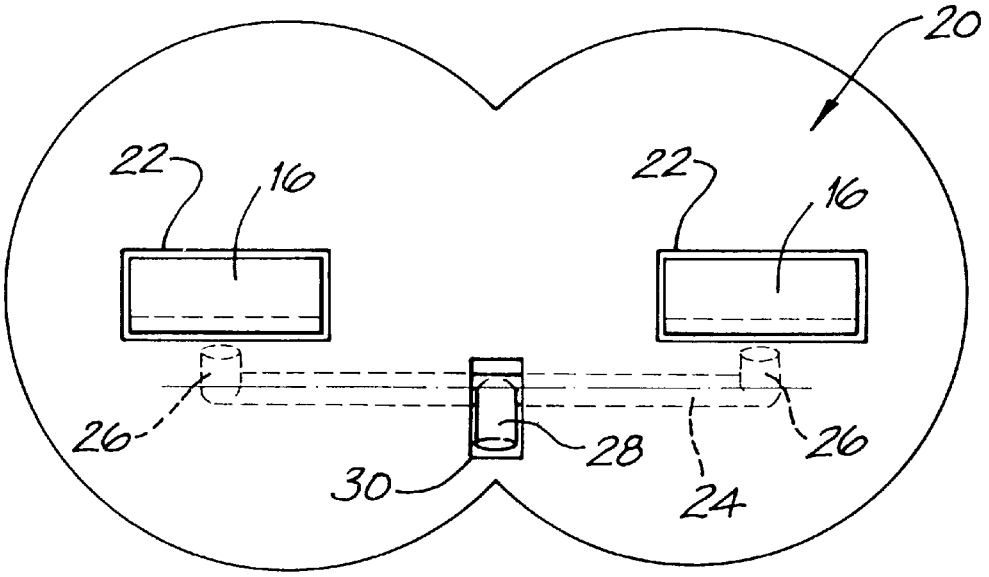
FIGS. 4 and 5 are plan views of a fixing plug according to the first embodiment, in disengaged and engaged positions respectively.
Figure 5:
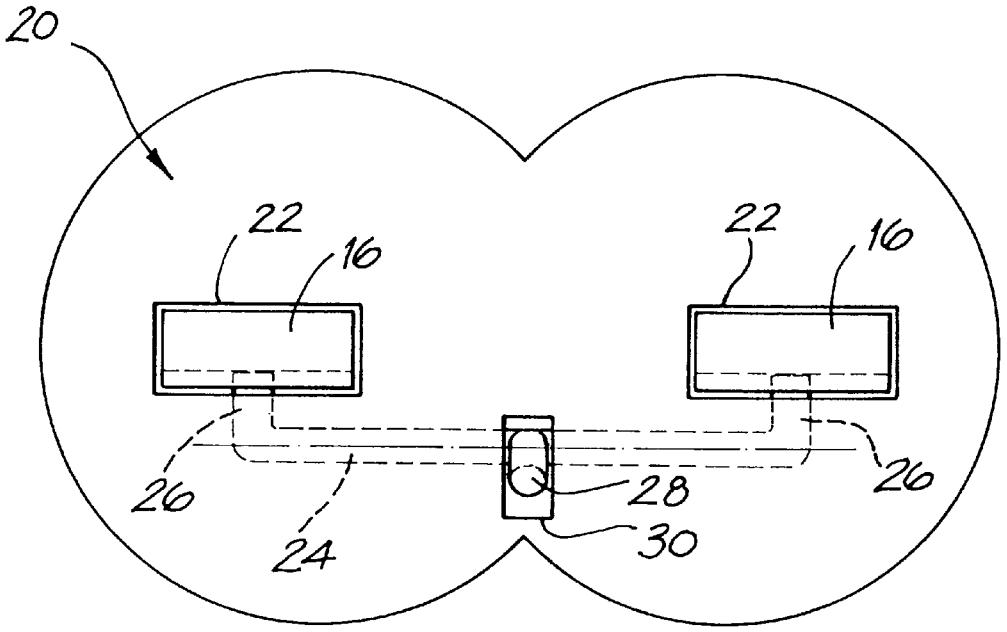
Figure 6:
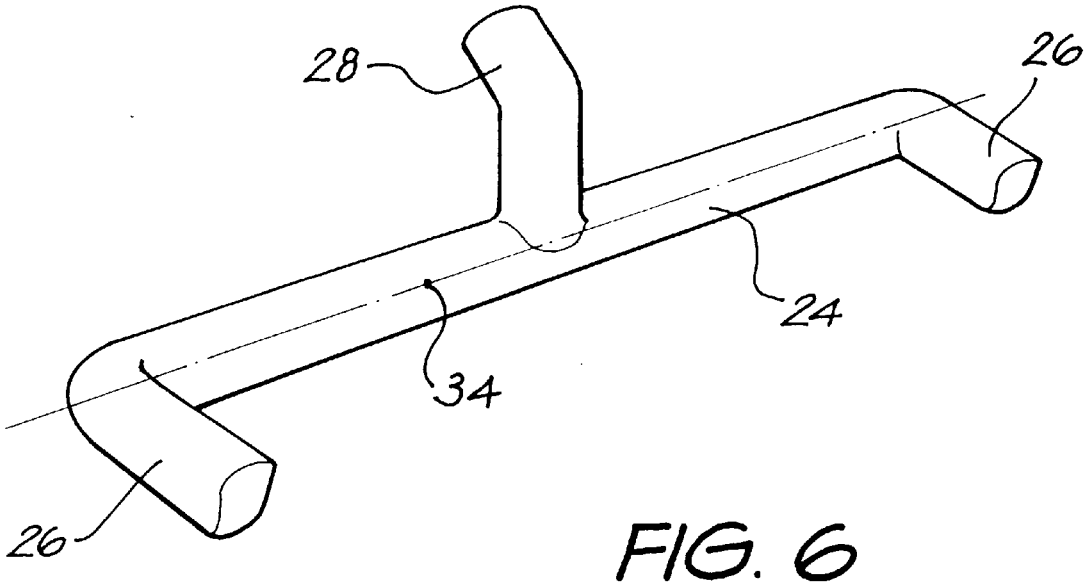
FIG. 6 is a schematic perspective of the cam from FIGS. 4 and 5.

Referring to FIGS. 1 to 3, a generally planar surf fin 10 has an end surface 12 for abutting against a fibreglassed lower surface of the surfboard and a pair of opposite lateral surfaces 14. Extending from the end surface 12 of the fin are fixing formations, in the form of a pair of spaced tabs 16, which may be generally rectangular in end view.

An elongate surfboard 18 is adapted for the fitting of three fins in accordance with the present invention by embedding fixing plugs 20 during manufacture of the board, generally in the manner described in Patent Application No. 34088/93, the contents of which are incorporated herein by reference. Briefly, holes are drilled in the bottom surface of the board, after glassing of the board, and a cutter is used to remove a portion of the foam material from a region extending from the base of the hole to the skin on the deck of the board. The plug is then positioned in the hole, suspended by lugs (not shown) on the plug and polyester or other suitable resin is poured into the cavity surrounding the plug to bond the plug into the board.

The outer surface of the plug and positioning lugs are removed during sanding of the surfboard. It will be noted that the depth of plug removed during sanding may vary between installations, resulting in variability in the depth of penetration of the fin tabs into the cavities of the plug. It is important that the means for securing the fin tabs in the plug will tolerate this variability.

The fixing of the plugs differs from that in Australian Patent No. 657456 in that a single plug 20 is provided for each fin, and is formed with an outer shape approximately two or more overlapping cylinders in order to facilitate fixing in a hole formed in the board using a circular hole saw. Each plug 20 has a pair of fixing cavities 22 which receive respective tabs 16 on the base of the fin.

FIGS. 4 to 7 illustrate a first embodiment of the fixing plug 20. Positioned inside the plug and running parallel to the fin is a horizontal cam rod 24 having transverse cam projections 26 at positions corresponding to each tab and a lever arm 28 for part rotation of the cam rod about its axis. The lever arm is accessible via an access slot 30 in the plug surface, and the user may be supplied with a tool for actuating the lever.

With the cam in its non-engaging position, with lever arm 28 at the fin-remote end of its travel and cam projections 26 not entering the fixing cavities 22, the fin is inserted until the end surfaces of the fin abut the top surface of the plug. The fin tabs 16 are closely received in the fixing cavities 22. The cam is then pivoted towards the fin using the lever arm 28 until the cam projections bear laterally (and optionally also downwards) on the tabs. This provides a quick and simple fin fixing mechanism.

Figure 7:
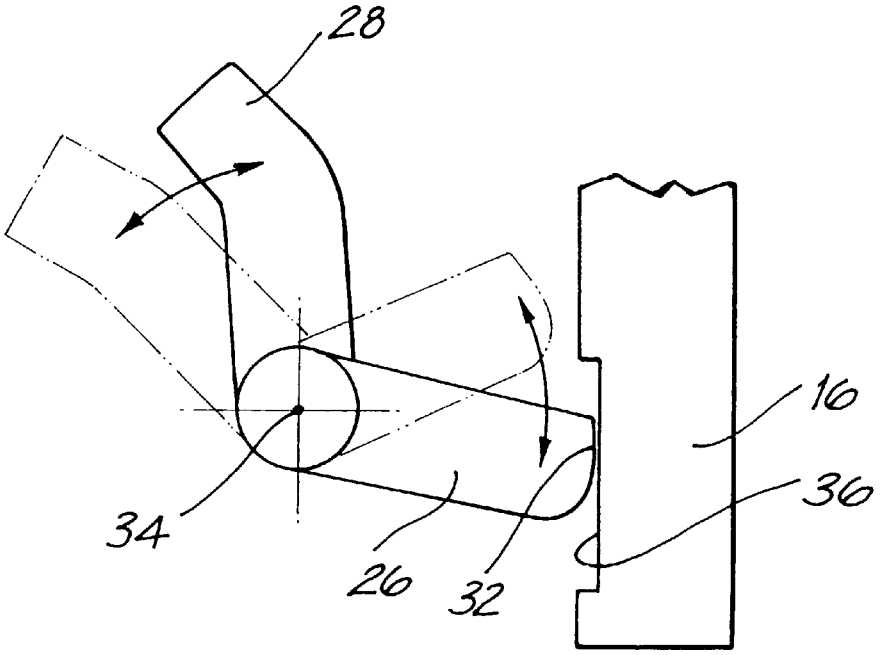
FIG. 7 is an end view of the engagement of the cam with the tab.

FIG. 7 is a detail in end view showing engagement of the cam with the tab 16. The disengaged position of the cam is shown in ghost. The end face 32 of the cam projection 26 makes an angle of slightly less than 90° with a line intersecting the axis 34 of the cam, so that the cam when engaged with a recess 36 in the tab is overcentred to lock into position.

Figure 8:
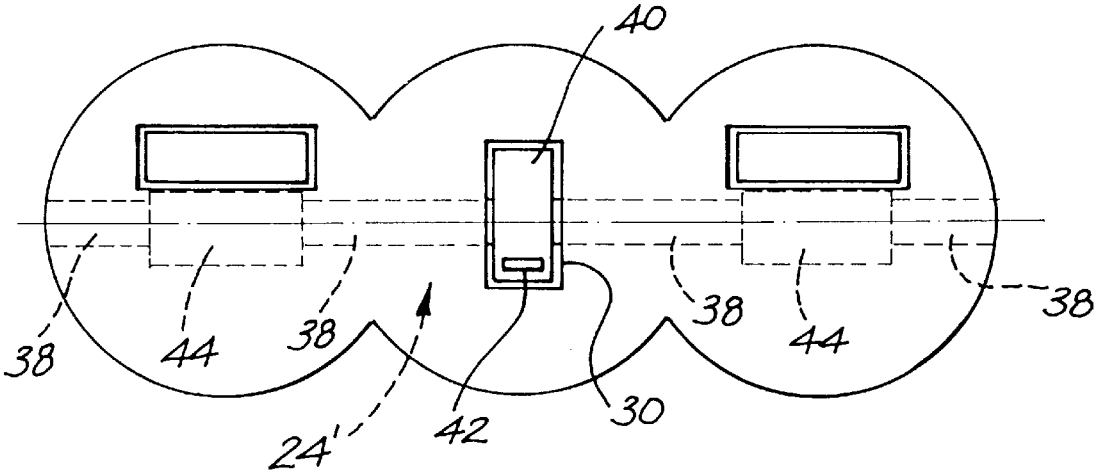
FIGS. 8 and 9 are plan views of a fixing plug according to a second embodiment, in disengaged and engaged positions respectively.
Figure 9:
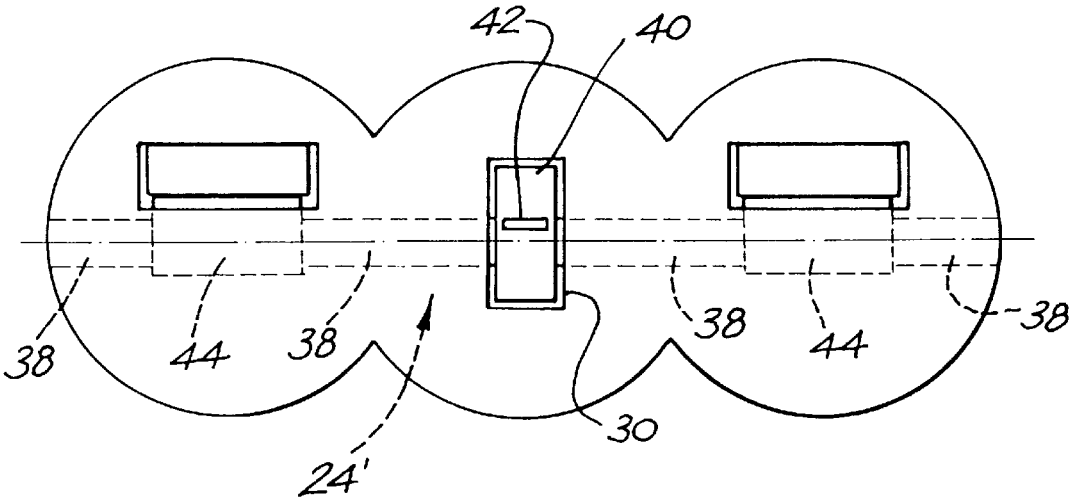

FIGS. 8 and 9 illustrate an alternative plug construction, similar in operation to FIGS. 4 to 7.

The plug of FIGS. 8 and 9 is shaped as three overlapping cylinders. The cam 24' consists of a series of cylindrical sections 38 journalled closely in the plug for smooth rotation of the cam about its axis, a larger diameter section 40 with a lug 42 or series of sockets accessible to a tool inserted through the cam access slot 30, and a pair of eccentric portions 44 reach communicating with the side of the respective fixing cavity. In the retracted position, the eccentric portions 44 align with the side wall of the fixing cavities to allow insertion and removal of the fins, while rotation of the cam causes the eccentric portions to extend a small distance into the fixing cavity and bear against the fin tabs 16 to secure the fin.

The plug construction of FIGS. 8 and 9 is particularly advantageous as the eccentric portions 44 extend along substantially the whole length of fixing cavities, ensuring a relatively large contact area with the tabs to minimise wear. Also, the cam is closely supported within the plug at each of the four cylindrical journal portions 38, at each end and between the fixing cavities, to reduce distortion of the cam under the lateral forces acting on the fin during surfing.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein.

I claim:

1. A surf fin fixing assembly for a surfcraft, having one or more fixing elements adapted to be embedded in the surfcraft, the elements having a fixing cavity therein adapted to receive a fixing formation, a surf fin having a pair of generally vertical lateral surfaces, an end surface and one or more fixing formations adapted to be received in the fixing cavities, a cam having a generally horizontal pivot axis parallel to the fin and means for rotating the cam to apply a force to a said fixing formation.

2. A surf fin fixing assembly according to claim 1 wherein the cam axis is laterally displaced from said fixing cavity.

3. A surf fin fixing assembly according to claim 1 wherein the fixing element is elongate in the longitudinal direction of the cam.

4. A surf fin fixing assembly for a surfcraft, having one or more fixing elements adapted to be embedded in the surfcraft, the elements having a fixing cavity therein adapted to receive a fixing formation; a surf fin having a pair of generally vertical lateral surfaces, an end surface and one or more fixing formations adapted to be received in the fixing cavities; a cam having a generally horizontal pivot axis parallel to the fin, and means for rotating the cam to apply a force to said fixing formation, wherein the fixing element is shaped as two or more overlapping cylinders.

5. A surf fin fixing assembly for a surfcraft, having one or more fixing elements adapted to be embedded in the surfcraft, the elements having a fixing cavity therein adapted to receive a fixing formation; a surf fin having a pair of generally vertical lateral surfaces, an end surface and one or more fixing formations adapted to be received in the fixing cavities; a cam having a generally horizontal pivot axis parallel to the fin, and means for rotating the cam to apply a force to said fixing formation, wherein one fixing element receives a single fin.

6. A surf fin fixing assembly according to claim 5 wherein the surf fin has a pair of said fixing formations which are received in one or more fixing cavities of said fixing element.

7. A surf fin fixing assembly for a surfcraft, having one or more fixing elements adapted to be embedded in the surfcraft, the elements having a fixing cavity therein adapted to receive a fixing formation; a surf fin having a pair of generally vertical lateral surfaces, an end surface and one or more fixing formations adapted to be received in the fixing cavities, a cam having a generally horizontal pivot axis parallel to the fin; and means for rotating the cam to apply a force to said fixing formation wherein one fixing element receives a single fin, the surf fin having a pair of said fixing formations which are received in one or more fixing cavities of said fixing elements, and wherein the cam applies lateral force to both of said fixing formations.

8. A surf fin fixing assembly according to claim 7 wherein the cam is journalled within the fixing element at spaced locations along its length.

9. A surf fin fixing assembly according to claim 8 wherein the cam is journalled adjacent respective ends thereof and at a location between said pair of fixing formations.

10. A surf fin fixing assembly for a surfcraft, having one or more fixing elements adapted to be embedded in the surfcraft, the elements having a fixing cavity therein adapted to receive a fixing formation, a surf fin having a pair of generally vertical lateral surfaces, an end surface and one or more fixing formations adapted to be received in the fixing cavities, a cam having a generally horizontal pivot axis parallel to the fin, and means for rotating the cam to apply a lateral force to said fixing formation.

* * * * *